United States Patent [19]

Way, Jr.

[11] 4,319,427

[45] Mar. 16, 1982

[54] MAGNET EFFECTED ADVANCING TOY

[76] Inventor: Lee V. Way, Jr., 46 Robert Oaks Dr., Newark, Del. 17913

[21] Appl. No.: 255,771

[22] Filed: Apr. 20, 1981

[51] Int. Cl.[3] ..... A63H 33/26

[52] U.S. Cl. ..... 46/241; 46/44; 46/124

[58] Field of Search ..... 46/236, 238, 239, 240, 46/241, 242, 124, 44, 132, 149; 273/1 M; 272/8 R

[56] References Cited

U.S. PATENT DOCUMENTS

| | | | |
|---|---|---|---|
| 2,618,889 | 11/1952 | Wigal | 46/241 X |
| 2,895,429 | 7/1959 | Baermann | 46/236 |
| 3,490,172 | 1/1970 | Schwartz | 46/124 X |

*Primary Examiner*—Robert Peshock
*Assistant Examiner*—Mickey Yu
*Attorney, Agent, or Firm*—B. B. Olive

[57] ABSTRACT

An apparatus, particularly adapted for use as a toy, advances itself in steps over a ferromagnetic surface utilizing a mechanically actuated structure on which relatively movable permanent magnets and magnet shields are mounted.

7 Claims, 7 Drawing Figures

MAGNET EFFECTED ADVANCING TOY

DESCRIPTION

1. Technical Field

The invention relates broadly to apparatus utilizing magnets to achieve motion and especially to toys having associated permanent magnet motion-producing mechanisms.

2. Background Art

The attraction of a permanent magnet for ferromagnetic material is well known. Various toys and games have used permanent magnets and magnetic effects for amusement and recreational purposes. In at least some applications, a shunt has been employed to control the force with which a magnet is attracted to ferromagnetic materials. For example, it has been known to employ a keeper with the well-known horseshoe-type child's toy magnet to increase the life of the magnet. Electromagnetic devices have also been employed to achieve motion, to drive apparatus and the like. So far as is known, it has not heretofore been known to utilize a pair of spaced apart permanent magnets with an intermittently mechanically driven associated magnetic shielding or shunting apparatus as a means for obtaining intermittent motion in a toy or the like placed on a surface formed of ferromagnetic material.

With the foregoing background in mind, the object of the invention, in a general sense, becomes that of using permanent magnets in what is believed to be a new mechanical arrangement to achieve motion on a ferromagnetic surface particularly in connection with toys and other amusement devices.

DISCLOSURE OF INVENTION

The apparatus of the invention is adapted to releasably hold and step itself on a surface exhibiting attraction for permanent magnetism. More specifically, the invention apparatus is especially intended for use in toys and other amusement devices and employs a pair of magnet assemblies with structural means enabling the magnet assemblies to be shielded and unshielded sequentially so as to impart a step-by-step type motion to the structure when placed on a surface formed of ferromagnetic materials.

BEST MODE FOR CARRYING OUT THE INVENTION

Figures 1, 2, 3, 4, 5, 6, 7:
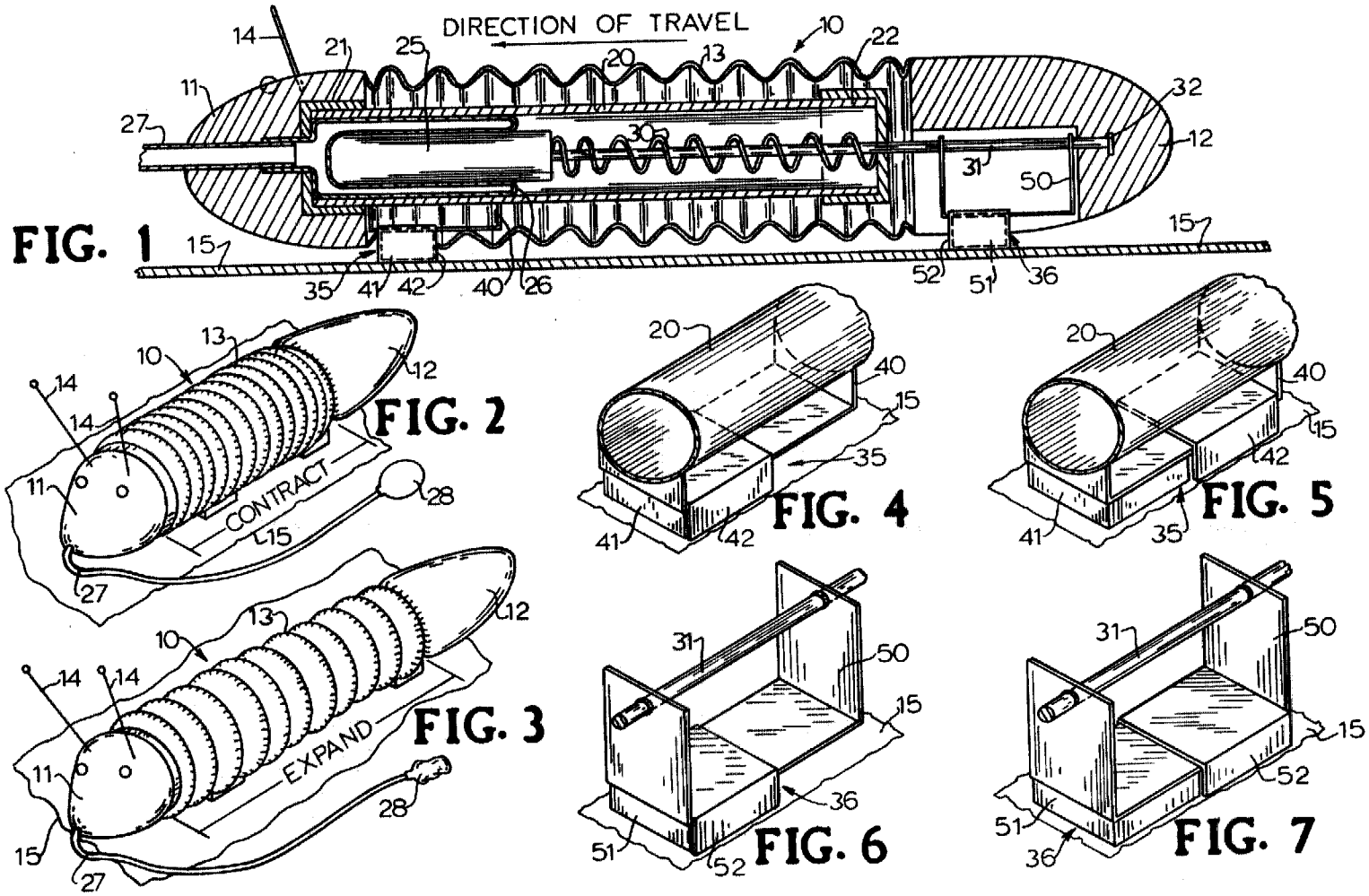
FIG. 1 is a cross section view through a toy apparatus intended to simulate a worm which advances itself by expanding and contracting its body.
FIG. 2 is a perspective view illustrating the simulated worm apparatus of the invention in a contracted condition.
FIG. 3 is a perspective view illustrating the simulated worm apparatus of the invention in an expanded condition.
FIG. 4 is a partial perspective view of the front magnet assembly employed in the FIG. 1 apparatus and in a magnetically shielded condition.
FIG. 5 is a perspective view of the FIG. 4 magnet assembly in an unshielded condition.
FIG. 6 is a perspective view of the rear magnet assembly of FIG. 1 shown in a magnetically shielded condition.
FIG. 7 is a perspective view of the rear magnet assembly of FIG. 6 in an unshielded condition.

The invention apparatus is illustrated as being embodied in a simulated toy worm 10 designed to simulate creeping by contraction and expansion of the simulated worm toy as later explained in more detail. The toy worm 10 moves on a sheet 15 of ferromagnetic material simulating a ground surface.

A simulated head 11 mounts simulated antennae 14 and is mounted opposite and spaced lengthwise from a simulated tail piece 12 joined to nose piece 11 by a flexible tubular cover 13 adapted to be expanded and contracted as further illustrated in connection with FIGS. 2 and 3. Nose piece 11, tail piece 12, and cover 13 are colored and decorated in a manner appropriate to the natural worm being simulated.

Within the housing provided by cover 13 there is mounted a rigid tube 20 having a front end cap 21 mounted within and secured to nose piece 11 and a rear end cap 22 mounted on the rear end of tube 20. An expandable balloon 26 is mounted within tube 20 and is expanded and collapsed utilizing connecting air tube 27 and air bulb 28. A plunger 25 is mounted within balloon 26 in the manner illustrated and is secured to a rod 31 surrounded within tube 20 by compression coil spring 30 and having a terminal end 32 secured within the rear tail piece 12.

From the description thus far given, it can be seen that by pressing and releasing bulb 28, balloon 26 can be expanded and contracted and thereby cause plunger 25 through the operation of rod 31 and spring 30 to move nose piece 11 and tail piece 12 apart and together in coordination with pressing and releasing bulb 28. The description will next proceed to the manner in which the forces created by pressing and releasing bulb 28 are converted to a step-by-step simulated worm creeping action in the toy worm 10 of the invention.

Worm 10 is provided with a front magnet assembly 35 and a rear magnet assembly 36. The front magnet assembly 35 comprises a U-shaped support 40 formed of nonmagnetic material, e.g., plastic, brass, aluminum, or the like, and is secured rigidly below and to the forward end of tube 20 as illustrated in FIG. 1. A permanent magnet 41 is rigidly secured to the front outside surface of support 40. Magnet 41 is adapted to slidably engage and be magnetically coupled to the ferromagnetic sheet material 15. An inverted U-shaped shield member 42 formed of ferromagnetic material slides on and is limited in its travel by the upturned ends of support 40. Shield 42, like magnet 41, is adapted to slidably engage and be magnetically coupled to the ferromagnetic sheet material 15. Shield 42 provides, in effect, a magnetic flux shunt such that when shield 42 is in position to cover magnet 41 to the maximum extent shield 42 in magnetic association with magnet 41 will assert their maximum combined magnetic force or attraction for the ferromagnetic sheet material 15. However, when support 40 moves forwardly and carries magnet 41 forwardly and from beneath shield 42, the association of shield 42 and magnet 41 assert a minimum magnetic force or attraction for the ferromagnetic sheet material 15. Thus, by reciprocating support 40 and its attached magnet 41, shield 42 can be moved relative to magnet 41 and between shielding and unshielding positions enabling shield 42 to be effectively strongly attached or loosely attached to the surface provided by ferromagnetic sheet 15 and thereby control the force required to slide magnet 41 and shield 42 on sheet 15.

The rear magnetic assembly 36 is of a construction similar to the construction employed in the front magnet assembly 35. In this regard, it will be noted that an upturned U-shaped support 50 formed of nonmagnetic material, e.g., brass, aluminum, plastic, or the like, is rigidly secured to and below rod 31 within the tail piece 12. Magnet 51 is rigidly secured below and to the forward portion of support 50. Magnet 51, like magnet 41, is adapted to slidably engage and be magnetically coupled to the ferromagnetic sheet material 15. A magnet shield member 52 comprising an inverted U-shaped member formed of ferromagnetic material slides on support 50 within the limits of travel provided by the upturned ends of support 50. Shield 52, like shield 42, is also adapted to slidably engage and be magnetically coupled to the ferromagnetic sheet material 15. As previously explained in connection with the front magnet 41, it will be noted that when the magnetic shield is over and effectively surrounds magnet 51, shield 52 and magnet 51 will assert their maximum combined magnetic attractive force for the ferromagnetic sheet material 15. However, when the magnet 51 is moved forwardly by support 50 and from beneath shield 52, shield 52 and magnet 51 will assert their combined minimum magnetic attraction for sheet 15 thereby minimizing the force required to move magnet 51 and shield 52 on the surface of sheet 15.

FIGS. 4 and 5 further illustrate the relative movement of front magnet 41 and front shield 42 on front support 40 when magnet is shielded, as in FIG. 4 and unshielded as in FIG. 5. In the same respect, FIG. 6 indicates the relative movement and positions of the rear magnet 51 and the rear magnetic shield 52 on the rear support 50 when the magnet is shielded as in FIG. 6 and unshielded as in FIG. 7.

From the foregoing description, it can be seen that when bulk 28 is squeezed, balloon 26 is inflated which causes the plunger or piston 25 and its attached rod 31 to push against the rear magnet assembly 36. This action causes the rear magnet 51 to be shielded by the rear shield 52 as illustrated in FIG. 6 thereby causing the rear shield 52 to be relatively strongly magnetically adhered to the ferromagnetic sheet material 15. At the same time, the front magnet assembly 35 is caused to be unshielded, in the manner illustrated in FIG. 5, by causing tube 20 to be pushed forwardly carrying front support 40 and magnet 41 forwardly and causing shield 42 to move rearwardly on front support 40 and thereby unshield magnet 41. At this stage, the rear magnet assembly 36 through rear shield 52 will be strongly magnetically adhered to the ferromagnetic sheet material 15 whereas the front magnet assembly 35 will be relatively loosely magnetically adhered because of having less magnetic attraction between front shield 42 and the ferromagnetic sheet material 15. This difference in attractive force between the rear magnet assembly 36 and the front magnet assembly 34 allows tube 20 to effectively advance and thereby slide magnet 41 and shield 42 of the front magnet assembly 35 forwad on sheet 15 while being maintained in essentially the position illustrated in FIG. 5 until plunger 25 has reached its maximum extent of travel.

Bulb 28 is released when piston plunger 25 reaches its maximum limit of travel. As bulb 28 starts to reinflate, the front shield 42 will remain in position magnetically adhered to the ferromagnetic sheet material 15 while front support 40 together with magnet 41 moves rearwardly until magnet 41 is fully shielded by shield 42. The front shield 42 and front magnet 41 in such shielded position are securely magnetically adhered to the ferromagnetic sheet material 15 as pressure is removed from bulb 28. Thus, as bulb 28 reinflates, the action of spring 30 will cause the piston plunger 25 to return to the contracted position shown in FIG. 1 and at the same time will cause support 50 and the rear magnet 51 to move forwardly. Magnet 51 will move from beneath shield 52 to unshield magnet 51. At this time, the front magnet assembly 35 will be relatively strongly magnetically adhered to the ferromagnetic sheet material 15 whereas the rear magnet assembly 36 will be relatively loosely magnetically adhered to the ferromagnetic sheet 15 thereby allowing the rear tail piece 21 and the rear magnet assembly 36 to be moved forwardly in the direction of travel indicated. By repetitive operation of bulb 28 a push-pull type of action simulating the inching-type action of a worm is achieved.

A wide variety of small, relatively thin, rectangular-shaped permanent magnets are readily available for purposes of the invention and can be sized to suit the application desired. In one embodiment, permanent magnets of approximately ⅝" by 6/8" by ⅛" thick were employed in a simulated toy worm with satisfactory results.

While an air bulb is illustrated to actuate the invention mechanism, battery operated motors, spring wound or hand-operated mechanisms, and the like, with appropriate linkage can be employed to actuate the invention mechanism and effect the desired relative movements.

A wide variety of alloys are known to be suited to being permanently magnetized and to being adapted to forming permanent magnets for purposes of the invention. It is further recognized that a wide range of ferromagnetic and alloy material suited to providing a magnetic flux path could be used for the magnet shields. Also, while sheet 15 is illustrated and described as being of a ferromagnetic material, it will be recognized that the toy apparatus 10 of the invention could be made to move on any surface formed of a material sufficiently magnetic in nature to attract the type of permanent magnets and magnet shields being employed. The invention as embodied in a toy has been found to be particularly amusing to children as well as to adults when crawling up the side of a household appliance such as a refrigerator or stove which are typically made of ferromagnetic sheet material thus being ideally suited to the invention as a support surface.

Also to be noted is that the magnet and shield support structures 40, 50 while preferably made of a material such as brass, aluminum, or a molded plastic exhibiting essentially no magnet attracting property, could be made of a material having some degree of magnetic attracting property without destroying the structure's usefulness for the invention. What is thus to be appreciated is that the precise magnetic and nonmagnetic properties of the elements making up the front and rear magnet assemblies can vary within readily determined practical limits while remaining useful for purposes of the invention.

I claim:

1. An apparatus adapted to releasably hold and step itself on a surface formed of a permanent magnet attracting material, said apparatus comprising:

(a) a pair of magnet assemblies, each assembly comprising:

(i) a permanent magnet adapted to being magnetically coupled to said surface in a slidably engaging relation;

(ii) a magnetic flux shielding member also adapted to being magnetically coupled to said surface in a slidably engaging relation; and (iii) a structure formed of a material and in a manner adapted to maintain the magnetic coupling of said magnet and shielding member to said surface when in a coupled relation thereto and mounting said magnet and shielding member on said structure in a manner enabling said magnet and shielding member to move with respect to each other within defined limits of travel enabling said magnet to be magnetically shielded and unshielded to control magnetic adhesion of said assembly to said surface;

(b) structural means mounting said magnet assemblies in a manner enabling the shielding member and magnet of each assembly to reciprocate relative to each other and each said assembly to be restrained in movement when its respective magnet is fully shielded while the other magnet of the other said assembly is less shielded and said other assembly moves relative thereto; and (c) actuator means mounted on said structural means and adapted to effect repetitive relative movements of said magnets and shielding members and in conjunction with said structural means to effect step-by-step motion of said apparatus over said surface in a predetermined direction.

2. An apparatus as claimed in claim 1 wherein said structural means is formed so as to simulate a worm.

3. An apparatus as claimed in claim 2 wherein each said magnet is fixedly secured to the said structure with which it is associated and each said shielding member is adapted to slide on said structure within said defined limits of travel.

4. An apparatus as claimed in claim 1 wherein said actuator means includes a balloon and a bulb inflator associated with a spring-loaded piston connected to a rod with the force of said piston bearing on a first said magnet assembly and the force of said rod bearing on a second magnet assembly when said balloon is inflated by said bulb to cause the said first magnet assembly to advance relative to the said second magnet assembly and when said balloon is deflated to cause in response to the force of the said spring associated with said piston said second magnet assembly to advance relative to said first magnet assembly.

5. An apparatus as claimed in claim 2 wherein said structural means includes simulated head and tail portions and a connecting contractable and expandable tubular structure joining said head and tail portions to simulate the body action of said worm.

6. An apparatus adapted to releasably hold and step itself on a surface formed of a permanent magnet attracting material, comprising:

(a) a pair of permanent magnets each being adapted to being magnetically coupled to said surface in a slidably engaging relation;

(b) a pair of magnet shields one for each said magnet, each being adapted to being magnetically coupled to said surface in a slidably engaging relation and each being further adapted to move relative to a respective one of said magnets to effect shielding and unshielding thereof when magnetically coupled to said surface;

(c) a structure mounting said magnets and shields in adjustable spaced relation; and (d) means to move said magnets and shields on said structure in a repetitive sequence of relative motion to shield and unshield said magnets separately and move said structure in a step-by-step manner by utilizing the sequential differences in magnetic adhesion of the said shields to said surface.

7. An apparatus adapted to releasably hold and step itself on a surface formed of a permanent magnet attracting material, comprising:

(a) a pair of permanent magnets adapted to be magnetically coupled to said surface in a slidably engaging relation;

(b) a pair of magnet shields one for each said magnet and adapted to be magnetically coupled to said surface in a slidably engaging relation; and (c) structural operator means mounting one of said magnets and one of said shields as an assembly at one location and the other of said magnets and the other of said shields as an assembly at another location and including actuator means operative to effect repetitive relative motion between the magnet and shield of each assembly in a predetermined sequence so as to establish repetitive differences in strength of magnetic adhesion of the assemblies to said surface and further operative to translate such differences into a step-by-step motion of said apparatus on said surface.

* * * * *